US008678305B2

(12) United States Patent
Matlin et al.

(10) Patent No.: US 8,678,305 B2
(45) **Date of Patent: *Mar. 25, 2014**

(54) RESTRICTIVE THROAT MECHANISM FOR PAPER SHREDDERS

(75) Inventors: Tai Hoon K. Matlin, Round Lake Beach, IL (US); James Waring, Libertyville, IL (US)

(73) Assignee: Fellowes, Inc., Itasca, IL (US)

( * ) Notice: Subject to any disclaimer, the term of this patent is extended or adjusted under 35 U.S.C. 154(b) by 536 days.

This patent is subject to a terminal disclaimer.

(21) Appl. No.: 12/487,220

(22) Filed: Jun. 18, 2009

(65) Prior Publication Data

US 2010/0320299 A1 Dec. 23, 2010

(51) Int. Cl.

| | |
|---|---|
| ***B02C 4/32*** | (2006.01) |
| ***B02C 7/14*** | (2006.01) |
| ***B02C 9/04*** | (2006.01) |
| ***B02C 11/08*** | (2006.01) |

(52) U.S. Cl.
USPC ..... 241/36; 241/100; 241/101.3; 241/236

(58) Field of Classification Search
USPC ..... 241/36, 100, 236, 101.3
See application file for complete search history.

(56) References Cited

U.S. PATENT DOCUMENTS

| | | | |
|---|---|---|---|
| 2,221,516 | A | 4/1937 | Hathaway |
| 3,619,537 | A | 11/1971 | Hosokawa et al. |
| 3,724,766 | A | 4/1973 | Bosland |
| 3,764,819 | A | 10/1973 | Muller |
| 3,785,230 | A | 1/1974 | Lokey |
| 3,829,850 | A | 8/1974 | Guetersloh |
| 3,947,734 | A | 3/1976 | Fyler |
| 4,192,467 | A | 3/1980 | Hatanaka |
| 4,352,980 | A | 10/1982 | Hibari |
| 4,378,717 | A | 4/1983 | Schneider et al. |

(Continued)

FOREIGN PATENT DOCUMENTS

| | | |
|---|---|---|
| DE | 3313232 | 10/1984 |
| DE | 8619856.4 | 10/1988 |

(Continued)

OTHER PUBLICATIONS

Notification of Transmittal of International Search Report, Search Report and Written Opinion of the International Searching Authority for PCT/2010/038993, mailed Feb. 22, 20011.

(Continued)

*Primary Examiner* — Bena Miller
(74) *Attorney, Agent, or Firm* — Pillsbury Winthrop Shaw Pittman, LLP

(57) ABSTRACT

A shredder includes a housing having a throat for receiving articles be shredded and a shredder mechanism. The shredder mechanism includes a motor and cutter elements, and enables the articles to be shredded to be fed into the cutter elements. The motor drives the cutter elements to shred the articles. A cam mechanism is provided in the throat and is movable from a disengaged position to an engaged position responsive to insertion into the throat of articles above a predetermined maximum thickness threshold. In the engaged position, the cam mechanism engages the articles to prevent further insertion thereof into the throat, and in the disengaged position the cam mechanism is disengaged from the articles to permit further insertion thereof into the throat. The cam mechanism may be movable between a closed position and an open position. In the closed position, the cam mechanism is configured to block the throat.

29 Claims, 13 Drawing Sheets

(56) References Cited

U.S. PATENT DOCUMENTS

| | | | | |
|---|---|---|---|---|
| 4,489,897 | A | 12/1984 | Turner | |
| 4,495,456 | A | 1/1985 | Vercillo et al. | |
| 4,497,478 | A | 2/1985 | Reschenhofer | |
| 4,545,537 | A * | 10/1985 | Kimura et al. | 241/36 |
| 4,683,381 | A | 7/1987 | Dufoug | |
| 4,707,704 | A | 11/1987 | Allen | |
| 4,757,949 | A | 7/1988 | Horton | |
| 4,814,632 | A | 3/1989 | Glaeser | |
| 4,815,669 | A | 3/1989 | Fujii | |
| 4,842,205 | A | 6/1989 | Araki | |
| 4,889,291 | A | 12/1989 | Goldhammer et al. | |
| 4,890,797 | A | 1/1990 | Fujii et al. | |
| 4,914,721 | A | 4/1990 | Glaeser | |
| 5,017,972 | A | 5/1991 | Daughton | |
| 5,066,150 | A * | 11/1991 | Babler et al. | 400/157.3 |
| 5,081,406 | A | 1/1992 | Hughes et al. | |
| 5,139,205 | A | 8/1992 | Gallagher et al. | |
| 5,166,679 | A | 11/1992 | Vranish et al. | |
| 5,167,374 | A | 12/1992 | Strohmeyer | |
| 5,186,398 | A | 2/1993 | Vigneau, Jr. | |
| 5,195,435 | A * | 3/1993 | Morrone et al. | 101/151 |
| 5,198,777 | A | 3/1993 | Masuda et al. | |
| 5,342,033 | A | 8/1994 | Iwata | |
| 5,345,138 | A | 9/1994 | Mukaidono et al. | |
| 5,353,468 | A | 10/1994 | Yap | |
| 5,397,890 | A | 3/1995 | Schueler et al. | |
| 5,409,171 | A | 4/1995 | Stangenberg et al. | |
| 5,415,355 | A | 5/1995 | Gollwitzer | |
| 5,429,313 | A | 7/1995 | Schwelling | |
| 5,453,644 | A | 9/1995 | Yap | |
| 5,494,229 | A | 2/1996 | Rokos | |
| 5,539,322 | A | 7/1996 | Zoughi et al. | |
| 5,662,280 | A | 9/1997 | Nishio et al. | |
| 5,743,521 | A | 4/1998 | Munakata et al. | |
| 5,772,129 | A | 6/1998 | Nishio et al. | |
| 5,775,605 | A | 7/1998 | Tsai | |
| 5,823,529 | A | 10/1998 | Mandel | |
| 5,850,342 | A | 12/1998 | Nakamura et al. | |
| 5,871,162 | A | 2/1999 | Rajewski | |
| 5,924,637 | A | 7/1999 | Niederholtmeyer | |
| D412,716 | S | 8/1999 | Kroger | |
| 5,942,975 | A | 8/1999 | Sorenson | |
| D414,198 | S | 9/1999 | Iwata | |
| 5,988,542 | A | 11/1999 | Henreckson | |
| 6,065,696 | A | 5/2000 | Tsai | |
| D426,805 | S | 6/2000 | Iwata | |
| 6,079,645 | A | 6/2000 | Henreckson et al. | |
| 6,116,528 | A | 9/2000 | Schwelling | |
| 6,141,883 | A | 11/2000 | Mitchell et al. | |
| 6,265,682 | B1 | 7/2001 | Lee | |
| 6,376,939 | B1 | 4/2002 | Suzuki et al. | |
| 6,418,004 | B1 | 7/2002 | Mather et al. | |
| 6,550,701 | B1 | 4/2003 | Chang | |
| 6,561,444 | B1 | 5/2003 | Yokomine et al. | |
| 6,601,787 | B1 | 8/2003 | Langenecker | |
| 6,655,943 | B1 | 12/2003 | Peterson | |
| 6,666,959 | B2 | 12/2003 | Uzoh et al. | |
| 6,676,460 | B1 | 1/2004 | Motsenbocker | |
| 6,698,640 | B2 | 3/2004 | Hakozaki | |
| 6,724,324 | B1 | 4/2004 | Lambert | |
| 6,802,465 | B1 | 10/2004 | Norcott et al. | |
| 6,979,813 | B2 | 12/2005 | Avril | |
| 6,983,903 | B2 | 1/2006 | Chang | |
| 6,997,408 | B2 | 2/2006 | Watano | |
| 7,025,293 | B2 | 4/2006 | Matlin et al. | |
| 7,040,559 | B2 | 5/2006 | Matlin | |
| 7,166,561 | B2 | 1/2007 | Allen | |
| 7,210,867 | B1 | 5/2007 | Silverbrook | |
| 7,213,780 | B2 | 5/2007 | Chen | |
| 7,311,276 | B2 | 12/2007 | Matlin et al. | |
| 7,520,452 | B2 | 4/2009 | Watano et al. | |
| 7,624,938 | B2 | 12/2009 | Aries et al. | |
| 7,631,822 | B2 | 12/2009 | Matlin et al. | |
| 7,631,823 | B2 | 12/2009 | Matlin et al. | |
| 7,631,824 | B2 | 12/2009 | Matlin et al. | |
| 7,635,102 | B2 | 12/2009 | Matlin et al. | |
| 7,661,614 | B2 | 2/2010 | Matlin et al. | |
| 7,663,769 | B2 | 2/2010 | Hayashihara et al. | |
| 7,712,689 | B2 | 5/2010 | Matlin et al. | |
| 2003/0016365 | A1 | 1/2003 | Liess et al. | |
| 2003/0042342 | A1 | 3/2003 | Kroger et al. | |
| 2004/0008122 | A1 | 1/2004 | Michael | |
| 2004/0069883 | A1 | 4/2004 | Watanabe et al. | |
| 2004/0159198 | A1 | 8/2004 | Peot et al. | |
| 2004/0194594 | A1 | 10/2004 | Dils et al. | |
| 2004/0226800 | A1 | 11/2004 | Pierga | |
| 2005/0046651 | A1 | 3/2005 | Askren et al. | |
| 2005/0150986 | A1 | 7/2005 | Castronovo | |
| 2005/0213106 | A1 | 9/2005 | Weijers et al. | |
| 2006/0016919 | A1 | 1/2006 | Castronovo | |
| 2006/0054725 | A1 | 3/2006 | Matlin | |
| 2006/0091247 | A1 | 5/2006 | Matlin | |
| 2006/0219827 | A1 | 10/2006 | Matlin et al. | |
| 2006/0243631 | A1 | 11/2006 | Duke | |
| 2007/0007373 | A1 | 1/2007 | Matlin et al. | |
| 2007/0025239 | A1 | 2/2007 | Jain et al. | |
| 2007/0063082 | A1 | 3/2007 | Coleman | |
| 2007/0080252 | A1 | 4/2007 | Pierce | |
| 2007/0087942 | A1 | 4/2007 | Allen | |
| 2007/0164135 | A1 | 7/2007 | Zhong | |
| 2007/0164138 | A1 | 7/2007 | Allen | |
| 2007/0215728 | A1 | 9/2007 | Priester | |
| 2007/0221767 | A1 | 9/2007 | Matlin | |
| 2007/0246580 | A1 | 10/2007 | Matlin et al. | |
| 2007/0246581 | A1 | 10/2007 | Matlin et al. | |
| 2007/0246582 | A1 | 10/2007 | Aries et al. | |
| 2007/0246585 | A1 | 10/2007 | Matlin et al. | |
| 2007/0246586 | A1 | 10/2007 | Matlin et al. | |
| 2008/0093487 | A1 | 4/2008 | Lee | |
| 2008/0105772 | A2 | 5/2008 | Matlin | |
| 2008/0231261 | A1 | 9/2008 | Dengler et al. | |
| 2009/0025239 | A1 | 1/2009 | Pan | |
| 2009/0032629 | A1 | 2/2009 | Aries et al. | |
| 2009/0090797 | A1 | 4/2009 | Matlin et al. | |
| 2010/0051731 | A1 | 3/2010 | Matlin et al. | |
| 2010/0084496 | A1 | 4/2010 | Matlin et al. | |
| 2010/0102153 | A1 | 4/2010 | Matlin et al. | |
| 2010/0134805 | A1 | 6/2010 | Pan | |
| 2010/0170967 | A1 | 7/2010 | Jensen et al. | |
| 2010/0170969 | A1 | 7/2010 | Jensen et al. | |
| 2010/0176227 | A1 | 7/2010 | Davis et al. | |
| 2010/0181398 | A1 | 7/2010 | Davis et al. | |
| 2010/0213296 | A1 | 8/2010 | Sued et al. | |
| 2010/0213297 | A1 | 8/2010 | Sued et al. | |
| 2010/0213300 | A1 | 8/2010 | Matlin et al. | |
| 2010/0243774 | A1 | 9/2010 | Hu et al. | |
| 2010/0252661 | A1 | 10/2010 | Matlin et al. | |
| 2010/0252664 | A1 | 10/2010 | Matlin et al. | |
| 2010/0270404 | A1 | 10/2010 | Chen | |
| 2010/0282879 | A1 | 11/2010 | Chen | |
| 2010/0288861 | A1 | 11/2010 | Cai et al. | |
| 2010/0320297 | A1 | 12/2010 | Matlin et al. | |
| 2011/0210194 | A1 | 9/2011 | Davis et al. | |
| 2011/0272504 | A1 | 11/2011 | Matlin et al. | |
| 2011/0272505 | A1 | 11/2011 | Matlin et al. | |
| 2011/0280642 | A1 | 11/2011 | Ikeda et al. | |
| 2011/0297769 | A1 | 12/2011 | Matlin et al. | |
| 2011/0297770 | A1 | 12/2011 | Matlin et al. | |

FOREIGN PATENT DOCUMENTS

| | | |
|---|---|---|
| DE | 4121330 A1 | 1/1993 |
| DE | 4207292 | 1/1993 |
| DE | 4237861 | 5/1994 |
| DE | 4437348 | 4/1996 |
| DE | 19835093 | 2/1999 |
| DE | 202004000907 | 5/2005 |
| DE | 202004000907 U1 | 5/2005 |
| DE | 102006036136 | 1/2008 |
| DE | 202010001577 U1 | 11/2010 |
| EP | 268244 | 11/1987 |
| EP | 0392867 | 10/1990 |
| EP | 562076 | 9/1992 |
| EP | 524708 | 1/1997 |

(56) References Cited

FOREIGN PATENT DOCUMENTS

| | | | |
|---|---|---|---|
| EP | 0792691 | | 9/1997 |
| EP | 0818241 | | 1/1998 |
| EP | 856945 | | 1/1998 |
| EP | 855221 | | 7/1998 |
| EP | 1177832 | | 2/2002 |
| EP | 1195202 | | 4/2002 |
| EP | 2180290 | | 7/2008 |
| EP | 2022566 | | 2/2009 |
| GB | 1199903 | | 7/1970 |
| GB | 2171029 | | 8/1986 |
| GB | 2209963 | | 6/1989 |
| GB | 2440651 | | 2/2008 |
| GB | 2442942 | | 4/2008 |
| GB | 2451513 | | 2/2009 |
| JP | 52-1161 | A | 1/1977 |
| JP | 52-11691 | | 1/1977 |
| JP | 5311911 | | 3/1978 |
| JP | 57-070445 | | 4/1982 |
| JP | 57-070445 | U | 4/1982 |
| JP | S57-76734 | U | 5/1982 |
| JP | 58-223448 | | 12/1983 |
| JP | 59150554 | | 8/1984 |
| JP | 61-000702 | | 1/1986 |
| JP | 62183555 | | 11/1987 |
| JP | 63-173342 | | 11/1988 |
| JP | 2-277560 | | 11/1990 |
| JP | H2-303550 | | 12/1990 |
| JP | 04-157093 | | 5/1992 |
| JP | 04-0180852 | | 6/1992 |
| JP | 5-96198 | | 4/1993 |
| JP | H05-092144 | | 4/1993 |
| JP | 6-277548 | A | 10/1994 |
| JP | 7-299377 | A | 11/1995 |
| JP | 8-108088 | | 4/1996 |
| JP | 8-131861 | | 5/1996 |
| JP | 08-131962 | | 5/1996 |
| JP | 08-164343 | | 6/1996 |
| JP | 9-38513 | | 2/1997 |
| JP | 09075763 | | 3/1997 |
| JP | 09-150069 | | 10/1997 |
| JP | 9-262491 | | 10/1997 |
| JP | 10-048344 | | 2/1998 |
| JP | 11-216383 | | 8/1999 |
| JP | 11-304942 | | 11/1999 |
| JP | 2000346288 | | 12/2000 |
| JP | 2002-239405 | | 8/2002 |
| JP | 2002-239405 | A | 8/2002 |
| JP | 2004-321840 | | 11/2004 |
| JP | 2004-321993 | A | 11/2004 |
| WO | 2005070533 | A1 | 8/2005 |
| WO | 2006019985 | | 2/2006 |
| WO | 2006036370 | | 4/2006 |
| WO | 2007109753 | | 9/2007 |
| WO | 2007122364 | | 11/2007 |
| WO | 2007137761 | | 12/2007 |

OTHER PUBLICATIONS

Invitation to Pay Additional Fees with Partial International Search Report for PCT International Patent Application No. PCT/US2010/038993, mailed Dec. 6, 2010.

Complaint for Declaratory Judgment filed on Nov. 15, 2010 by Royal Applicance Manufacturing Co., d/b/a/ TTI Floor Care North America and Techtronic Industries Co. Ltd. against Fellowes, Inc.

ACCO REXEL, Mainstream 1050/2150/2250/3150/3250 and 3350, 115V Machines Illustrated Parts Lists and Services Instructions, Mar. 25, 2002, Issue No. 4.

ACCO REXEL, Deckside and Office 115V Machines Illustrated Parts Lists and Service Instructions, Aug. 18, 1999.

ACCO REXEL, Deckside and Office 230V Machines Illustrated Parts Lists and Service Instructions, Aug. 1, 2000.

English Translation of Japanese Patent Application Publication No. 9-38513, published on Feb. 10, 1997.

U.S. Appl. No. 60/613,750, filed Sep. 27, 2004, Pierce.

U.S. Appl. No. 60/686,490, filed May 31, 2005, Pierce.

U.S. Appl. No. 60/688,285, filed Jun. 7, 2005, Pierce.

TI's Digital signal Controllers Put Brake on SawStop Table Saw, Feb. 9, 2005, pp. 1-3. (printed from www.embeddedstar.com/press/content/2005/2/embedded17827.html).

GBC Shredmaster Service Manual, Part #6001054, referencing Models 2230S and 2250X Paper Shredders, Nov. 1997.

The Stationary and Business Machines—Japan, "DS-4000 by Carl Jimuki K.K.", Jun. 2003.

The Stationary and Business Machines—Japan, "NSE-501CN by Nakabayashi K.K.", Oct. 2004.

Notification Concerning Transmittal of International Preliminary Report on Patentability (Chapter I of the Patent Cooperation Treaty), mailed Jan. 5, 2012.

U.S. Non-Final Office Action in U.S. Appl. No. 12/817,762, dated Jan. 7, 2013.

* cited by examiner

RESTRICTIVE THROAT MECHANISM FOR PAPER SHREDDERS

BACKGROUND OF THE INVENTION

1. Field of the Invention

The present invention relates to shredders for destroying articles, such as documents, compact discs, etc.

2. Description of Related Art

Shredders are well known devices for destroying articles, such as paper, documents, compact discs ("CDs"), expired credit cards, etc. Typically, users purchase shredders to destroy sensitive information bearing articles, such as credit card statements with account information, documents containing company trade secrets, etc.

A common type of shredder has a shredder mechanism contained within a housing that is removably mounted atop a container. The shredder mechanism typically has a series of cutter elements that shred articles fed therein and discharge the shredded articles downwardly into the container.

A common frustration of users of shredders is to feed too many papers into the feed throat, only to have the shredder jam after it has started to shred the papers. The present invention endeavors to provide a shredder with a mechanism that prevents too many sheets of paper from being fed into the throat. In particular, the present invention uses a mechanism configured to engage the papers to prevent the further insertion into the throat of articles having a thickness above a predetermined thickness threshold.

BRIEF SUMMARY OF THE INVENTION

One aspect of the invention provides a shredder including a housing having a throat for receiving at least one article to be shredded therethrough and a shredder mechanism received in the housing. The shredder mechanism includes a motor and cutter elements, and enables the at least one article to be shredded to be fed into the cutter elements. The motor is operable to drive the cutter elements so that the cutter elements shred the articles fed therein into shredded particles. The shredder also includes a cam mechanism provided in the throat. The cam mechanism is biased to a disengaged position and movable to an engaged position responsive to insertion into the throat of the at least one article above a predetermined maximum thickness threshold. The cam mechanism is configured such that in the engaged position the cam mechanism engages the at least one article to prevent further insertion thereof into the throat, and in the disengaged position the cam mechanism is disengaged from the at least one article to permit further insertion thereof into the throat.

Another aspect of the invention provides a shredder including a housing having a throat for receiving at least one article to be shredded therethrough and a shredder mechanism received in the housing. The shredder mechanism includes a motor and cutter elements, and enables the at least one article to be shredded to be fed into the cutter elements. The motor is operable to drive the cutter elements so that the cutter elements shred the articles fed therein into shredded particles. The shredder also includes a cam mechanism provided in the throat. The cam mechanism is biased to an open position and movable to a closed position responsive to insertion into the throat of the at least one article above a predetermined maximum thickness threshold. The cam mechanism is configured such that in the open position the cam mechanism permits further insertion thereof into the throat and in the closed position the cam mechanism blocks the throat to prevent further insertion thereof into the throat.

Other aspects, features, and advantages of the present invention will become apparent from the following detailed description, the accompanying drawings, and the appended claims.

DETAILED DESCRIPTION OF THE INVENTION

The following embodiments are described with reference to the drawings and are not to be limiting in their scope in any manner.

Figure 1:
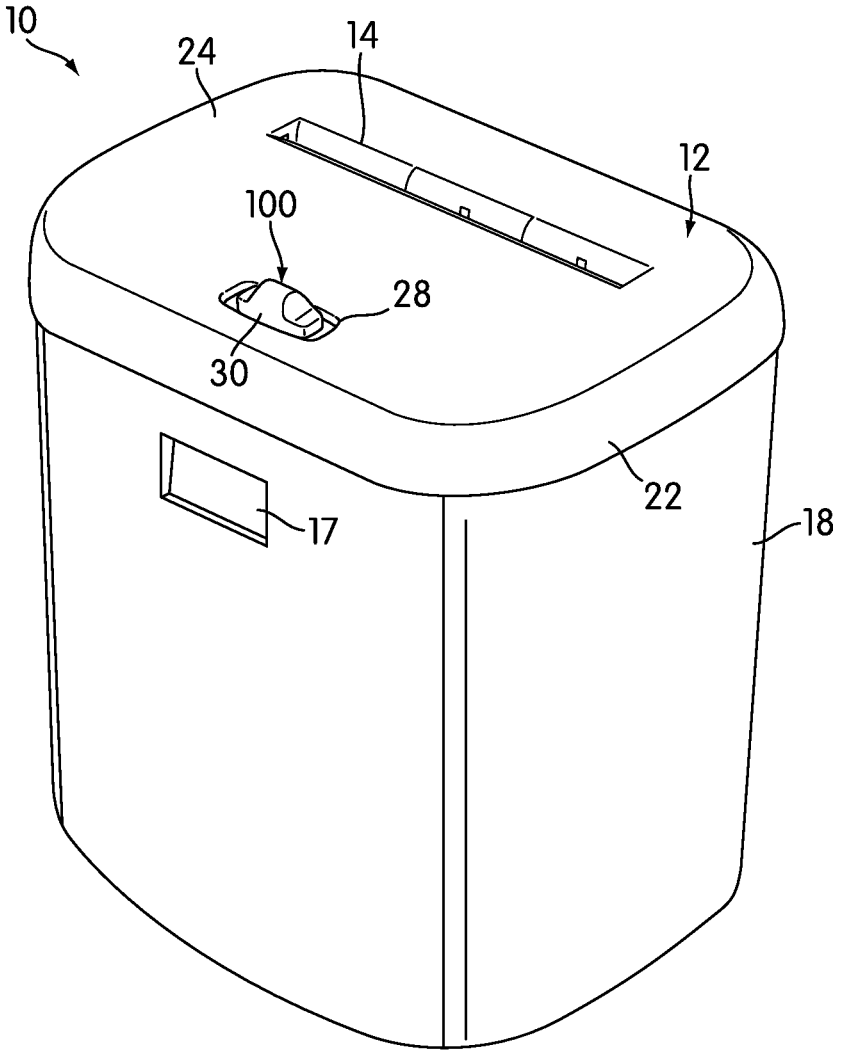
FIG. 1 is an perspective view of a shredder constructed in accordance with an embodiment of the present invention.

FIG. 1 is a top perspective view of a shredder apparatus 10 constructed in accordance with an embodiment of the present invention. The shredder 10 is designed to destroy or shred articles such as paper, paper products, CDs, DVDs, credit cards, and other objects. In an embodiment, the shredder 10 may comprise wheels (not shown) to assist in moving the shredder 10. The shredder 10 comprises a shredder housing 12 that sits on top of a container 18, for example.

The shredder housing 12 comprises at least one input opening 14 on an upper side 24 (or upper wall or top side or top wall) of the housing 12 for receiving materials to be shredded. The input opening 14 extends in a lateral direction, and is also often referred to as a throat. The input opening or throat 14 may extend generally parallel to and above a shredder mechanism 20 (described below). The input opening or throat 14 may be relatively narrow, so as to prevent overly thick items, such as large stacks of documents, from being fed into therein. However, the throat 14 may have any configuration. The throat 14 may have a first side 38 (see FIG. 4*a*) that is spaced apart from a second side 40 (see FIG. 4*a*), wherein the distance between the first side 38 and the second side 40 defines the thickness of the throat 14. In one embodiment, an additional or second input opening (not shown) may be provided in shredder housing 12. For example, input opening 14 may be provided to receive paper, paper products, and other items, while second input opening (not shown) may be provided to receive objects such as CDs and DVDs.

Figure 2:
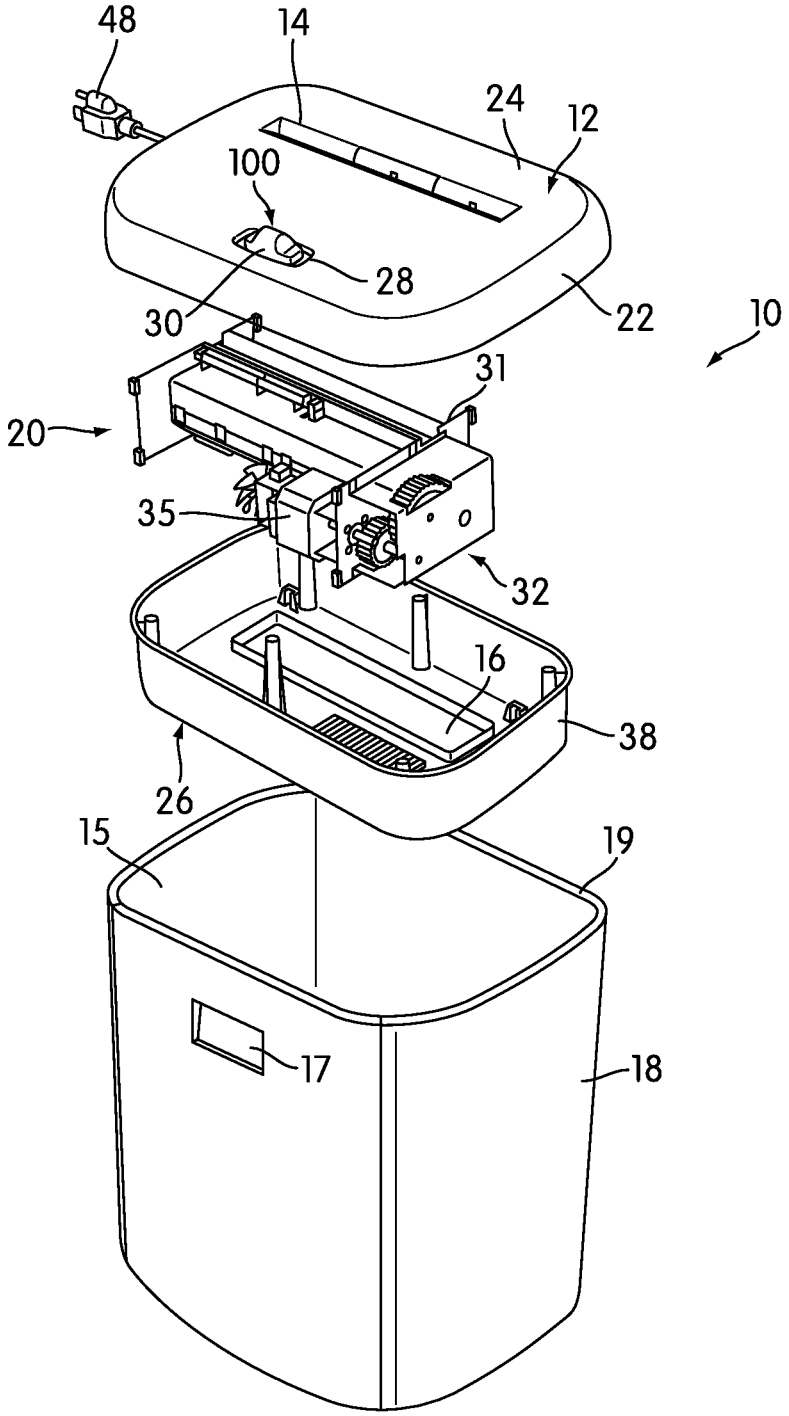
FIG. 2 is an exploded perspective view of a shredder constructed in accordance with an embodiment of the present invention.

Shredder housing 12 also comprises an output opening 16 on a lower side 26 (or bottom side or bottom wall or underside or bin side), such as shown in FIG. 2. In an embodiment, shredder housing 12 may include a bottom receptacle 38 with lower side 26 to receive shredder mechanism 20 therein. Bottom receptacle 38 is affixed to the underside of the upper side 24 or top wall base using fasteners, for example. The receptacle 38 has output opening 16 in its bottom side 26 or bottom wall through which shredded particles are discharged.

Generally speaking, the shredder 10 may have any suitable construction or configuration and the illustrated embodiments provided herein are not intended to be limiting in any way. In addition, the term "shredder" or "shredder apparatus," used interchangeably throughout this specification, are not intended to be limited to devices that literally "shred" documents and articles, but instead intended to cover any device that destroys documents and articles in a manner that leaves such documents and articles illegible and/or useless.

Figure 3:
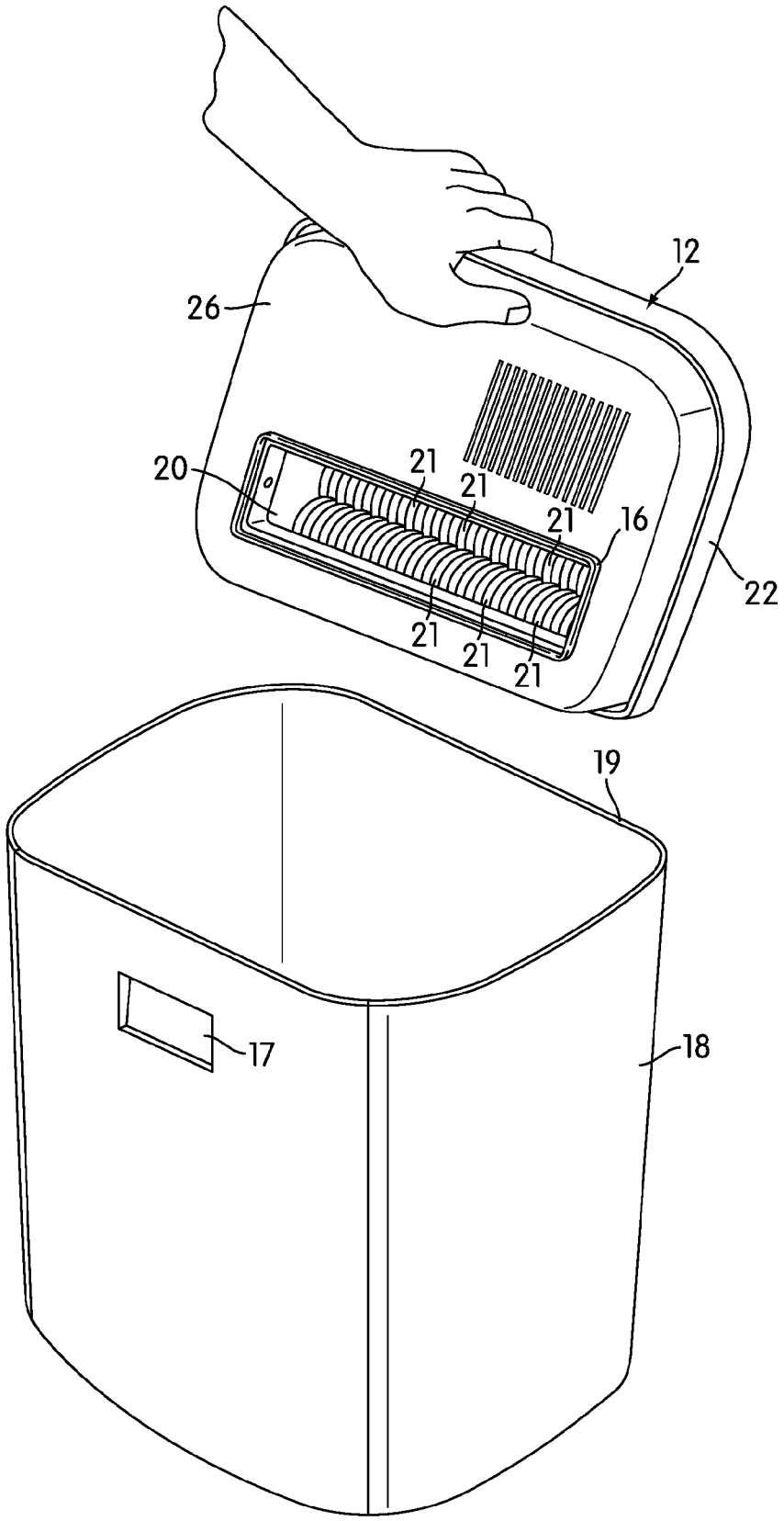
FIG. 3 is an detailed perspective view of a lower side of a shredder housing of a shredder apparatus in accordance with an embodiment of the present invention.

As noted, the shredder 10 also comprises a shredder mechanism 20 (shown generally in FIG. 2) in the shredder housing 12. When articles are inserted into the at least one input opening or throat 14, they are directed toward and into shredder mechanism 20. "Shredder mechanism" is a generic structural term to denote a device that destroys articles using at least one cutter element. Destroying may be done in any particular way. Shredder mechanism 20 includes a drive system 32 (generally shown in FIG. 2) with at least one motor 35, such as an electrically powered motor, and a plurality of cutter elements 21 (see FIG. 3). The cutter elements 21 are mounted on a pair of parallel mounting shafts (not shown). The motor 35 operates using electrical power to rotatably drive first and second rotatable shafts of the shredder mechanism 20 and their corresponding cutter elements 21 through a conventional transmission 37 so that the cutter elements 21 shred or destroy materials or articles fed therein, and, subsequently, deposit the shredded materials into opening 15 of container 18 via the output opening 16. The shredder mechanism 20 may also include a sub-frame 31 for mounting the shafts, motor, and transmission in the housing 12, for example. The drive system may have any number of motors and may include one or more transmissions. Also, the plurality of cutter elements 21 are mounted on the first and second rotatable shafts in any suitable manner. For example, in an embodiment, the cutter elements 21 are rotated in an interleaving relationship for shredding paper sheets and other articles fed therein. In an embodiment, the cutter elements 21 may be provided in a stacked relationship. The operation and construction of such a shredder mechanism 20 is well known and need not be discussed herein in detail. As such, the at least one input opening or throat 14 is configured to receive materials inserted therein to feed such materials through the shredder mechanism 20 and to deposit or eject the shredded materials through output opening 16.

The shredder 10 includes a cam mechanism 23 (see FIGS. 4*a* and 4*b*) provided in the throat 14. One or more of the cam mechanisms 23 may be spaced apart along the throat 14. The cam mechanism 23 may be biased to a disengaged position and movable to an engaged position responsive to insertion into the throat 14 of the at least one article above a predetermined maximum thickness threshold. The cam mechanism 23 may be configured such that in the engaged position the cam mechanism 23 engages the at least one article to prevent further insertion thereof into the throat 14, and in the disengaged position the cam mechanism 23 is disengaged from the at least one article to permit further insertion thereof into the throat 14. The cam mechanism 23 will be described in detail later.

Shredder housing 12 may be configured to be seated above or upon the container 18. As shown in FIG. 2, shredder housing 12 may comprise a detachable paper shredder mechanism. That is, in an embodiment, the shredder housing 12 may be removed in relation to the container 18 to ease or assist in emptying the container 18 of shredded materials. In an embodiment, shredder housing 12 comprises a lip 22 or other structural arrangement that corresponds in size and shape with a top edge 19 of the container 18. The container 18 receives paper or articles that are shredded by the shredder 10 within its opening 15. More specifically, after inserting materials into input opening 14 for shredding by cutter elements 21, the shredded materials or articles are deposited from the output opening. 16 on the lower side 26 of the shredder housing 12 into the opening 15 of container 18. The container 18 may be a waste bin, for example.

In an embodiment, the container 18 may be positioned in a frame beneath the shredder housing 12. For example, the frame may be used tow support the shredder housing 12 as well as comprise a container receiving space so that the container 18 may be removed therefrom. For example, in an embodiment, a container 18 may be provided to slide like a drawer with respect to a frame, be hingedly mounted to a frame, or comprise a step or pedal device to assist in pulling or removing it therefrom. Container 18 may comprise an opening, handle, or recess 17 to facilitate a user's ability to grasp the bin (or grasp an area approximate to recess 17), and thus provide an area for the user to easily grasp to separate the container 18 from the shredder housing 12, thereby providing access to shredded materials. The container 18 may be substantially or entirely removed from being in an operative condition with shredder housing 12 in order to empty shredded materials such as chips or strips (i.e., waste or trash) located therein. In an embodiment, the container or bin 18 may comprise one or more access openings (not shown) to allow for the deposit of articles therein.

Generally the terms "container," "waste bin," and "bin" are defined as devices for receiving shredded materials discharged from the output opening 16 of the shredder mechanism 20, and such terms are used interchangeably throughout this specification. However, such terms should not be limiting. Container 18 may have any suitable construction or configuration.

Typically, the power supply to the shredder 10 will be a standard power cord 44 with a plug 48 on its end that plugs into a standard AC outlet. Also, a control panel may be provided for use with the shredder 10. Generally, the use of a control panel is known in the art. As shown in FIG. 1, a power switch 100 or a plurality of switches may be provided to control operation of the shredder 10. The power switch 100 may be provided on the upper side 24 of the shredder housing 12, for example, or anywhere else on the shredder 10. The upper side 24 may have a switch recess 28 with an opening therethrough. An on/off switch 100 includes a switch module (not shown) mounted to housing 12 underneath the recess 28 by fastening devices, and a manually engageable portion 30 that moves laterally within recess 28. The switch module has a movable element (not shown) that connects to the manually engageable portion 30 to move the switch module between its states. Movement of the manually engageable portion of switch 100 moves the switch module between states. In the illustrated embodiment shown in FIG. 2, the switch module connects the motor 35 to the power supply. This connection may be direct or indirect, such as a connection via a controller (not shown). The term "controller" is used to define a device or microcontroller having a central processing unit (CPU) and input/output devices that are used to monitor parameters from devices that are operatively coupled to the controller. The input/output devices also permit the CPU to communicate and control the devices (e.g., such as a sensor or the motor 35) that are operatively coupled to the controller. As is generally known in the art, the controller may optionally include any number of storage media such as memory or storage for monitoring or controlling the sensors coupled to the controller.

The controller likewise communicates with the motor 35 of the shredder mechanism 20. When the switch 100 is moved to an on position, the controller can send an electrical signal to the drive of the motor 35 so that it rotates the cutting elements 21 of the shredder mechanism 20 in a shredding direction, thus enabling paper sheets to be fed in the throat 14 to be shredded. Additionally or alternatively, when the switch 100 is in an on position, the switch 100 may be set to an idle or ready position, which communicates with the control panel. The idle or ready position may correspond to selectively activating the shredder mechanism 20, for example. The controller may selectively enable the operation of the shredder mechanism 20 based on the detection of the presence or insertion of at least one article (e.g., paper) in the throat 14 by a sensor (not shown), such as an activation sensor. The switch 100 may also be moved to an off position, which causes the controller to stop operation of the motor 35.

The switch module contains appropriate contacts for signaling the position of the switch's manually engageable portion. As an option, the switch 100 may also have a reverse position that signals the controller to operate the motor 35 in a reverse manner. This would be done by using a reversible motor and applying a current that is of reverse polarity relative to the on position. The capability to operate the motor 35 in a reversing manner is desirable to move the cutter elements 21 in a reversing direction for clearing jams, for example. To provide each of the noted positions, the switch 100 may be a sliding switch, a rotary switch, or a rocker switch. Also, the switch 100 may be of the push switch type that is simply depressed to cycle the controller through a plurality of conditions.

Generally, the construction and operation of the switch 100 and controller for controlling the motor are well known and any construction for these may be used. For example, a touch screen switch, membrane switch, or toggle switches are other examples of switches that may be used. Also, the switch need not have distinct positions corresponding to on/off/idle/reverse, and these conditions may be states selected in the controller by the operation of the switch. Any of the conditions could also be signaled by lights, on a display screen, or otherwise.

In some embodiments, the shredder 10 may have activation sensors that are activated when the sensors detect articles that are inserted into the throat 14. When the switch is in its on (or idle) position, the controller 25 may be configured to operate the motor 13 to drive the cutter elements 26 of the shredder mechanism 20 in the shredding direction when the sensors detect the presence or insertion of the articles to be shredded. Having the sensors activate the shredder 10 is desirable because it allows the user to ready the shredder 10 by moving the switch to its on position, but the controller 25 will not operate the shredder mechanism 20 to commence shredding until the sensors detect the presence or insertion of one or more, articles in the throat 14. Once the articles have passed into the shredder mechanism 20 beyond the sensors, the controller 25 will then stop the movement or rotation of the cutter elements 21 of shredding mechanism 20, as that corresponds to the articles having been fully fed and shredded. Typically, a slight delay in time, such as 3-5 seconds, is used before stopping the shredder mechanism 20 to ensure that the articles have been completely shredded by the cutter elements 21 and discharged from the shredder mechanism 20. The use of such sensors to activate the shredder mechanism 20 is beneficial because it allows the user to perform multiple shredding tasks without having the shredder mechanism 20 operating, making noise, between tasks. It also reduces wear on the shredder mechanism 20, as it will only operate when substrates are fed therein, and will not continually operate.

The use of cam mechanisms to prevent further insertion into the throat 14 of articles above a predetermined thickness threshold may also help reduce wear on the shredder mechanism 20, as jamming of the shredder increases the strain on the shredder mechanism 20. The aforementioned predetermined thicknesses may be determined as follows. First, because the actual maximum thickness that the shredder mechanism 20 may handle will depend on the material that makes up the item to be shredded, the maximum thickness may correspond to the thickness of the toughest article expected to be inserted into the shredder, such as a compact disc, which is made from polycarbonate. If it is known that the shredder mechanism 20 may only be able to handle one compact disc at a time, the predetermined maximum thickness may be set to the standard thickness of a compact disc (i.e., 1.2 mm). It is estimated that such a thickness would also correspond to about 12 sheets of 20 lb. paper. Second, a margin for error may also be factored in. For example, the predetermined maximum thickness may be set to a higher thickness, such as to 1.5 mm, which would allow for approximately an additional 3 sheets of paper to be safely inserted into the shredder 10 (but not an additional compact disc). Of course these examples are not intended to be limiting in any way.

For shredders that include separate throats for receiving sheets of paper and compact discs and/or credit cards, a cam mechanism 23 may be provided in each of the throats and configured for different predetermined maximum thicknesses. For example, the same shredder Mechanism 20 may be able to handle one compact disc and 18 sheets of 20 lb. paper. Accordingly, the predetermined maximum thickness associated with the cam mechanism 23 associated with the throat 14 that is specifically designed to receive compact discs may be set to about 1.5 mm (0.3 mm above the standard thickness of a compact disc), while the predetermined maximum thickness associated with the cam mechanism 23 associated with the throat 14 that is specifically designed to receive sheets of paper may be set to about 1.8 mm. Of course, these examples are not intended to be limiting in any way and are only given to illustrate features of embodiments of the invention.

Figure 4A:
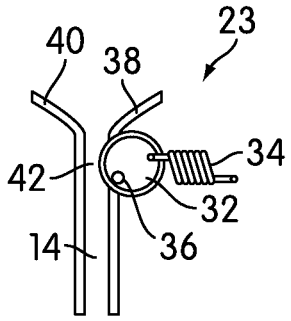
FIGS. 4*a*-4*b* are detailed views of a cam mechanism in accordance with a first embodiment of the present invention.

FIG. 4*a* shows the cam mechanism 23 in accordance with one embodiment of the invention. In this embodiment, the cam mechanism 23 includes a cam member 32 and a spring 34, wherein the spring 34 is operatively connected to the cam member 32 and to a portion of the shredder 10. In this embodiment, the second side 40 of the throat 14 and the cam member 32 are spaced apart to define an gap 42 through which articles may pass when the cam mechanism 23 is in the disengaged position. The gap 42 may be smaller than the thickness of the throat 14. As shown, the cam member 32 is configured to rotate around a pivot point 36 that may be provided near the outer circumference of the cam member 32 and in proximity to the first side 38 of the throat 14. That is, the pivot point 36 is eccentric to the cam wheel 34. As such, the cam member 32 is constructed and arranged to rotate closer in proximity towards the second side 40 of the throat 14 when the cam member 32 is rotated in a counterclockwise direction around the pivot point 36. The cam member 32 may be attached to a portion of the shredder at the pivot point 36 using an attachment mechanism, such as a pin, fastener, or other attachment mechanisms known in the art. It is contemplated that in other embodiments, the location of the pivot point 36 may vary.

Figure 4B:
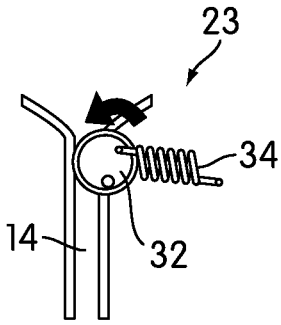

In some embodiments, the cam mechanism 23 is movable between the disengaged position (as shown in FIG. 4*a*) wherein the cam mechanism 23 permits further insertion of articles into the throat 14 and the engaged position (as shown in FIG. 4*b*) wherein the cam mechanism 23 prevents further insertion of articles into the throat 14. As shown in FIG. 4*a*, the spring 34 generally biases the cam mechanism 23 to the disengaged position until articles having a thickness above the predetermined thickness threshold are inserted into the throat 14. The cam mechanism 23 may be configured such that friction between the cam member 32 and the articles above the predetermined thickness threshold being inserted into the throat 14 may rotate the cam member 32 in a counterclockwise direction around the pivot point 36 to the engaged position. This results from the gap 42 being set equal to the predetermined thickness when the cam member 32 is in the disengaged position. As such, articles less than or equal to the predetermined thickness can pass through the gap 42, but articles greater than the predetermined thickness will frictionally engage the cam member 32 and move it to the engaged position. The spring 34 may be constructed and arranged to extend as the cam member 32 is rotated towards the second side 40 of the throat 14 to the engaged position. In the embodiment shown in FIG. 4*b*, when the cam mechanism 23 is in the engaged position, the cam member 32 engages the articles and the size of the gap 42 is reduced so that the articles cannot be further inserted into the throat 14.

In other words, the cam member 32 binds the articles against the second side 40 of the throat 14 in the engaged position. Because of the frictional engagement, further force attempting to insert the articles will cause further movement of the cam member 32 in the engaging direction, thus increasing the binding effect.

The term disengaged is used herein in the functional sense, meaning that the cam member 32 is in the position where it is not actively interfering with the insertion of the article(s). It is possible for there to be incidental contact between the articles and the cam member 32 in the disengaged position, as paper rarely travels perfectly straight, but the engagement is not frictionally sufficient to cause movement of the cam member 32 to the engaged position. Likewise, the term engaged is used herein similarly in the functional sense to mean that the cam member 32 is engaged with the articles by the friction therebetween to prevent their further insertion. Mere incidental contact between the cam member 32 and the article(s) does not establish the engaged position. These terms could also be referred to as frictionally disengaged and frictionally engaged in that sense.

Figure 5A:
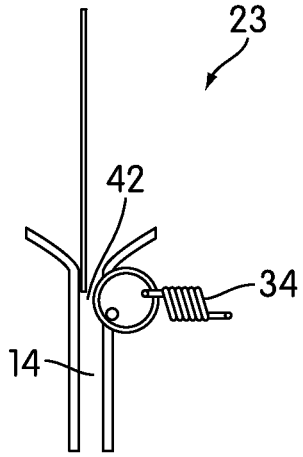
FIGS. 5*a*-5*b* are detailed views of the operation of the cam mechanism shown in FIGS. 4*a*-4*b;*
Figure 5B:
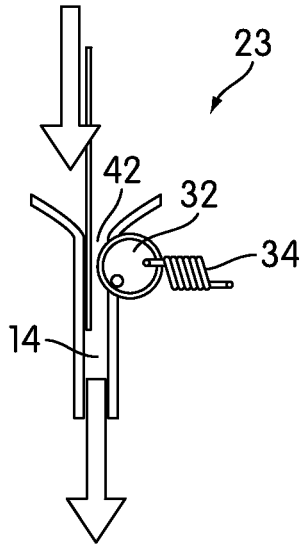

FIG. 5*a* shows the cam mechanism 23 in the disengaged position before articles having a thickness equal to or below the predetermined thickness threshold are inserted into the throat 14. In this embodiment, the articles must be inserted past the gap 42 to be further inserted into the throat 14. If the thickness of the articles is less than or equal to the predetermined thickness threshold, the articles may be inserted past the gap 42 to be further inserted into the throat 14 without actuating the cam mechanism 23 to the engaged position. It is contemplated that articles having a thickness less than or equal to the predetermined thickness threshold may contact the cam member 32 as the articles are inserted further into the throat 14. However, the articles might not have enough thickness, and thus might not provide enough friction against the cam member 32, to sufficiently rotate the cam member 32 so that the cam mechanism 23 may engage the articles. As the articles having a thickness equal to or below the predetermined thickness threshold are inserted farther into the throat 14 and come into contact with the cutter elements 21, the articles may be shredded by the shredder mechanism 20. In embodiments having the activation sensors, the insertion of the articles into the throat 14 activates the activation sensors, which then send signals to the controller to operate the shredder mechanism 20 to drive the cutter elements 21. As shown in FIG. 5*b*, articles having thickness equal to or below the predetermined maximum thickness threshold may be inserted past the gap 42 and further into the throat 14 to be shredded by the shredder mechanism 20.

Figure 6A:
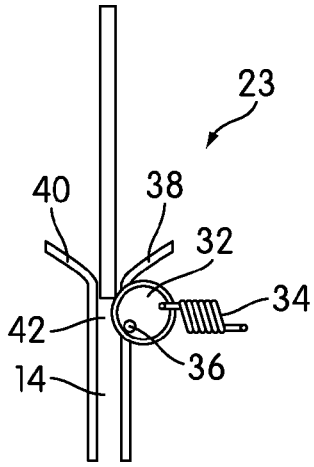
FIGS. 6*a*-6*c* are detailed views of the operation of the cam mechanism shown in FIGS. 4*a*-4*b;*
Figure 6B:
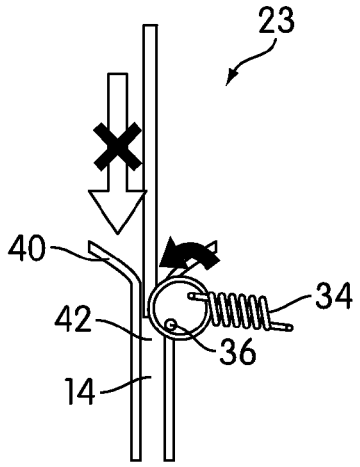

FIG. 6*a* shows the cam mechanism 23 in the disengaged position before articles having thickness above the predetermined thickness threshold are inserted into the throat 14. In this embodiment, the cam mechanism 23 is in the disengaged position wherein the spring 34 is in the default, relaxed state and the cam member 32 is disposed near the first side 38 of the throat 14. As shown, the cam mechanism 23 is constructed and arranged such that when articles having thickness above the predetermined thickness threshold are inserted into the throat 14 and into the gap 42, the articles contact the cam member 32 and the second side 40 of the throat 14. As the, articles are pushed in a downward direction further into the throat 14, friction between the articles and the outside surface of the cam member 32 "drags", or pulls, the cam member 32 in a downward direction, causing the cam member 32 to rotate in a counterclockwise direction around the pivot point 36 towards the second side 40 of the throat 14. In the embodiment shown in FIG. 6*b*, the cam member 32 is constructed and arranged to engage the articles and to decrease the size of the gap 42 until the articles are no longer able to be further inserted into the throat 14 when the cam member 32 is rotated in the counterclockwise direction towards the second side 40 of the throat 14. The rotation of the cam member 32 may cause the cam member 32 to force the articles against the second side 40 of the throat 14 and thus retain the articles between the cam member 32 and the second side 40 of the throat 14. The spring 34 may be configured to extend during the counterclockwise rotation of the cam member 32. The engagement of the articles by the cam mechanism 23 and the resulting inability to insert the articles into the throat 14 indicates to a user that the thickness of the articles must be reduced.

Figure 6C:
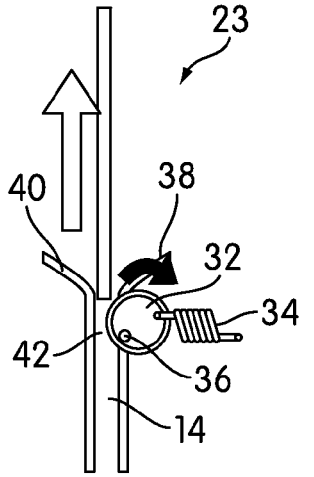

As shown in FIG. 6*c*, the user may remove the articles from their position between the second side 40 of the throat 14 and the engaged cam mechanism 23 by pulling the articles in an upward direction. Accordingly, the friction between the articles and the cam member 32 resulting from the upward motion of the articles may cause the cam member 32 to rotate in a clockwise direction around the pivot point 36 so that the size of the gap 42 is increased and the articles are no longer engaged by the cam member 32. As such, the extended spring 34 may then rotatably snap the cam member 32 back to the disengaged position.

Figure 7A:
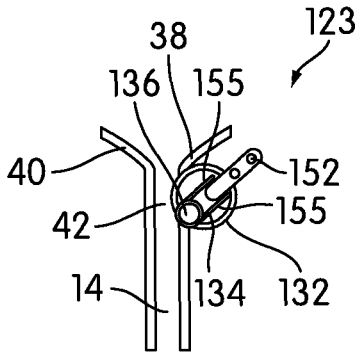
FIGS. 7*a*-7*b* are detailed views of a cam mechanism in accordance with a second embodiment of the present invention.
Figure 7B:
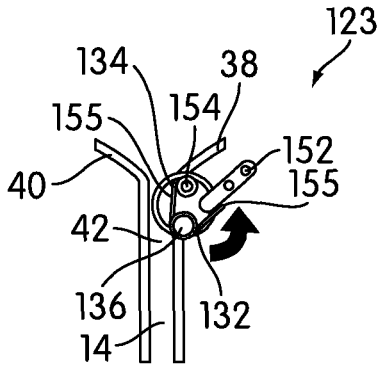

FIGS. 7*a*-7*b*, 8*a*-8*b*, and 9*a*-9*c* illustrate an alternative embodiment of the invention and the operation thereof. In the embodiment shown in FIG. 7*a*, the cam mechanism 123 includes a torsion spring 134. In this embodiment, the cam mechanism 123 further includes a position guide 152 attached to a portion of the shredder 10. The position guide 152 may be fixed such that the position guide 152 remains stationary regardless of the movement of the cam member 132 and the spring 134. As shown in FIG. 7*a*, the cam mechanism 123 may generally be biased in the disengaged position wherein the cam member 132 permits further insertion of articles into the throat 14. The cam member 132 may be spaced apart from the second side 40 of the, throat 14 to define the gap 42 through which the articles must pass to be further inserted into the throat 14. When the cam mechanism 123 is in the disengaged position, the spring 134 may be in a default, relaxed position. In contrast, in the embodiment shown in FIG. 7*b*, the cam mechanism 123 is in the engaged position wherein the cam member 132 prevents further insertion of articles into the throat 14. In the engaged position, the cam member 132 is closer in proximity to the second side 40 of the throat 14 than in the disengaged position and the size of the gap 42 is reduced so that articles may not be further inserted into the throat 14.

Figure 8A:
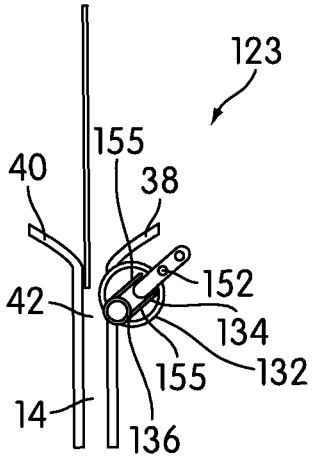
FIGS. 8*a*-8*b* are detailed views, of the operation of the cam mechanism shown in FIGS. 7*a*-7*b;*
Figure 8B:
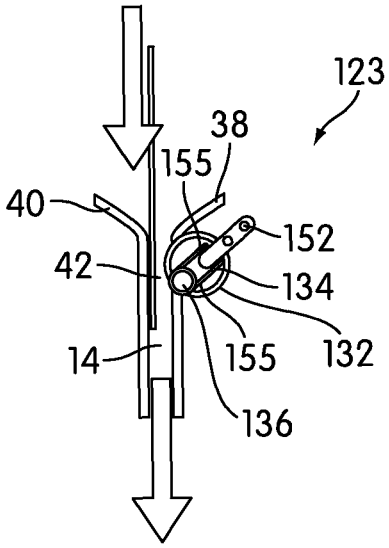

FIGS. 8*a* and 8*b* illustrate the insertion of articles having thickness less than or equal to the predetermined thickness threshold into the throat 14. In FIG. 8*a*, the cam mechanism 123 is in the disengaged position wherein the cam member 132 does not obstruct the throat 14. As shown in FIG. 8*b*, the articles are able to pass through the gap 42 to be further inserted into the throat 14 without the cam mechanism 123 engaging the articles. The articles are then able to be shred by the shredder mechanism 20 as the articles come into contact with the cutter elements 21.

Figure 9A:
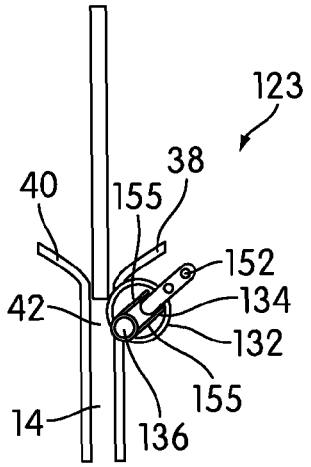
FIGS. 9*a*-9*c* are detailed views of the operation of the cam mechanism shown in FIGS. 7*a*-7*b;*
Figure 9B:
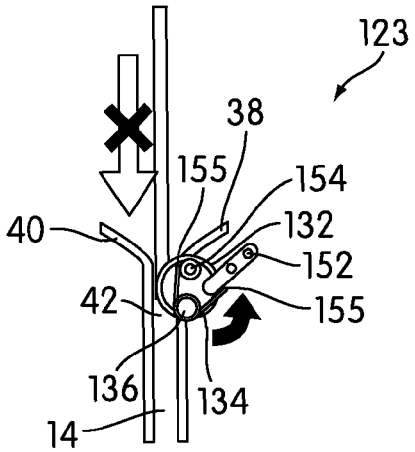
Figure 9C:
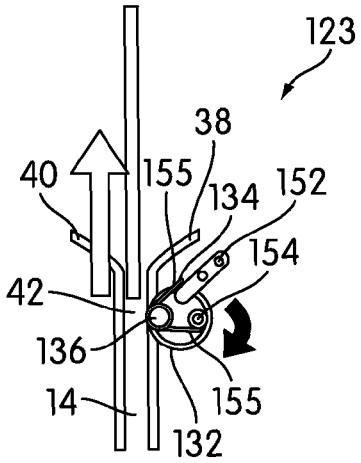

FIGS. 9*a*-9*c* illustrate the insertion into the throat 14 and the removal from the throat 14 of articles having thickness above the predetermined thickness threshold. In FIG. 9*a*, the cam mechanism 123 is in the disengaged position wherein the spring 134 is in the default position and the cam member 132 is not engaging the articles so that the articles may be inserted past the gap 42 to be further inserted into the throat 14. In this embodiment, the cam member 132 includes a stop member 154 positioned between two arms 155 of the spring 134. In one embodiment, when the cam mechanism 123 is in the disengaged position, the position guide 152 overlaps the stop member 154, as shown in FIG. 9*a*.

FIG. 9*b* illustrates the insertion of articles having thickness above the predetermined thickness threshold into the throat 14. As shown in FIG. 9*b*, the articles have sufficient thickness such that the friction between the articles and the cam member 132 "drags", or rotates, the cam member 132 downwardly in a counterclockwise direction around the pivot point 136. As the cam member 132 is rotated downwardly in a counterclockwise direction, the spring 134 is extended by the position guide 152 on one arm 155 of the spring 134 and by the stop member 154 on the other arm 155 of the spring 134.

Referring back to FIG. 9*b*, the articles are prevented from traveling further into the throat 14 by the cam member 132. The engagement of the articles by the cam mechanism 123 and the resulting inability to further insert the articles into the throat 14 indicates to a user that the thickness of the articles must be reduced. The user may then remove the articles from their position between the second side 40 of the throat and the engaged cam mechanism 123 by pulling the articles in an upward direction, as shown in FIG. 9*c*. In the embodiment shown in FIG. 9*c*, the friction created between the articles and the cam member 132 when the articles are pulled in the upward direction causes the cam member 132 to rotate in a clockwise direction towards the first side 40 of the throat 14. Accordingly, the cam member 132 is rotated out of the throat 14 and the spring 134 is extended by the position guide 152 and the stop member 154. In this Figure, the position of the position guide 152 relative to the stop member 154 is opposite of that shown in FIG. 9*b*. The cam mechanism 123 in this extended position facilitates the removal of the articles from the throat 14. After the articles have been pulled completely from the throat 14, the spring 134 may rotatably snap the cam member 132 back to the default disengaged position (as shown in FIG. 7*a*).

Figure 10A:
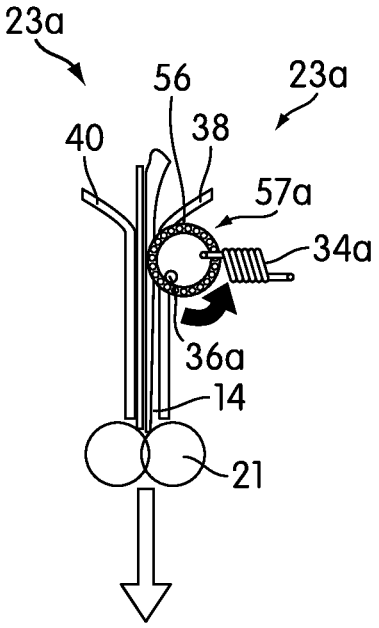
FIG. 10*a* is a detailed view of a cam mechanism in accordance with a third embodiment of the present invention.
Figure 10B:
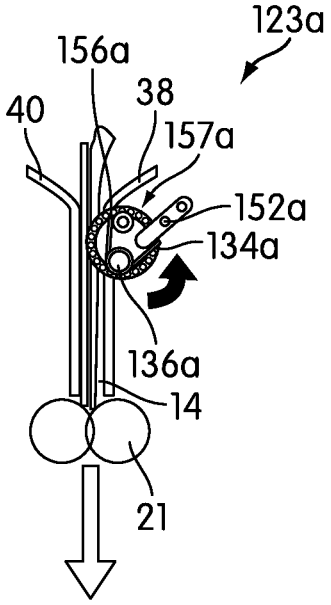
FIG. 10*b* is a detailed view of a cam mechanism in accordance with a fourth embodiment of the present invention.

FIG. 10*a* illustrates an embodiment of the cam mechanism 23*a* having a slip disk 57*a*. Similarly, FIG. 10*b* illustrates an embodiment of the cam mechanism 123*a* having the slip disk 157*a*. Because the cam mechanism 23*a* in FIG. 10*a* is generally similar to cam mechanism 23, similar reference numerals will be used in FIG. 10*a*, but with an "a" added. In addition, because the cam mechanism 123*a* in FIG. 10*b* is generally similar to cam mechanism 123, similar reference numerals will be used in FIG. 10*b*, but with an "a" added.

Figure 11:
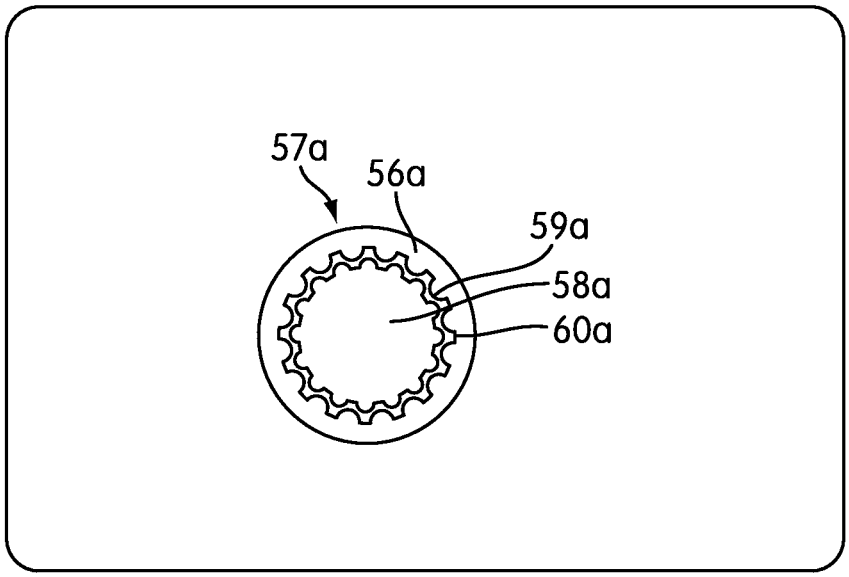
FIG. 11 is a detailed view of an outer ring in accordance with an embodiment of the present invention.

The slip disk 57*a* of the embodiment shown in FIG. 10*a* is shown in detail in FIG. 11. The slip disk 57*a* may comprise an outer ring 56*a* that is retained on a hub 58*a* via notches 60*a* located around the circumference of the hub 58*a*. It is contemplated that the hub 58*a* may be made of plastic, metal, wood, or any other materials known in the art. The outer ring 56*a* may be constructed and arranged to be rotatable relative to the hub 58*a*. The outer ring 56*a* is preferably made of rubber, but may be made of other materials known in the art. The slip disk 157*a* of the embodiment shown in FIG. 10*b* may be similar to the slip disk 57*a* shown in FIG. 11.

In the embodiment shown in FIG. 4*a*, when articles having a thickness equal to or less than the predetermined thickness threshold are able to be further inserted into the throat 14, wrinkles may accumulate on the articles. In one embodiment, the wrinkles on the articles may exert drag on the cam member 32, thus causing the cam member 32 to be rotated in the counterclockwise direction towards the engaged position. As such, the cam mechanism 23 may engage the articles and retain the articles between the cam member 32 and the second side 40 of the throat 14. However, if the articles have already been inserted far enough down the throat 14 to contact the cutter elements 21, the rotation of the cutter elements 21 may pull one portion of the articles in a downward direction while the other portion is engaged and retained by the cam member 32 against the second side 40 of the throat 14. Accordingly, the articles may tear or the cam mechanism 23 may break. In the embodiment shown in FIG. 10*a*, the slip disk 57*a* thus allows the articles to "slip out" or be disengaged from the engaged position between the cam member 32*a* and the second side 40 of the throat 14 when the articles are being pulled in the downward direction by the cutter elements 21. Similarly, in the embodiment shown in FIG. 10*b*, the slip disk 157*a* facilitates the removal of the articles from the engaged position between the cam member 132*a* and the second side 40 of the throat 14.

Specifically, the outer ring 56*a* is fixed to the hub 58*a* in a releasable or clutched manner such that, if a torque above a predetermined threshold is applied to the ring 56*a*, it will release, and rotate about the hub 58*a*. In the illustrated embodiment, this is achieved by the ring 56*a* having resilient teeth 59*a* on the inner surface thereof, and the hub 58*a* having notches 60*a* on the outer surface thereof. When the torque meets the threshold, the resilient teeth 59*a* will yield, thus disengaging from the notches 60*a* and permitting rotation between the ring 56*a* and the hub 58*a*. The resiliency of the teeth 59*a* enables them to reengage the notches 60*a* to reestablish the rotationally fixed relationship.

The resilient teeth 59*a* and notches 60*a* may be reversed on the ring 56*a* and hub 58*a*. Other arrangements may also be used, such as resilient intermeshing teeth on both the ring 56*a* and hub 58*a* inner and outer surfaces. Likewise, a frictional engagement between the ring 56*a* and hub 58*a* could also be used. Any releasable or clutch engagement between the ring 56*a* and hub 58*a* may be used.

The predetermined thickness threshold may be varied by varying the location of the pivot point, the radius of the cam member, and the elasticity of the spring. It is contemplated that the configurations and arrangements of the components of the cam mechanisms may be varied depending on the sizes of the throats in different embodiments and the preferred predetermined thickness thresholds.

Figure 12A:
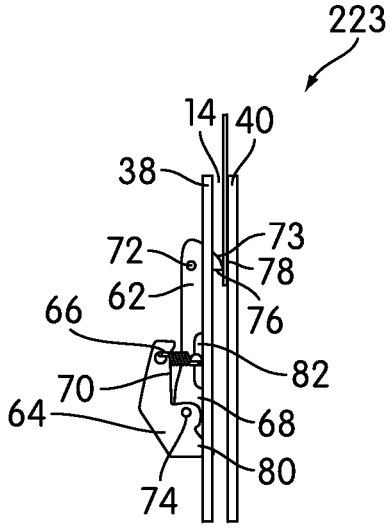
FIGS. 12*a*-12*b* are detailed views of a cam mechanism in accordance with a fifth embodiment of the present invention.
Figure 12B:
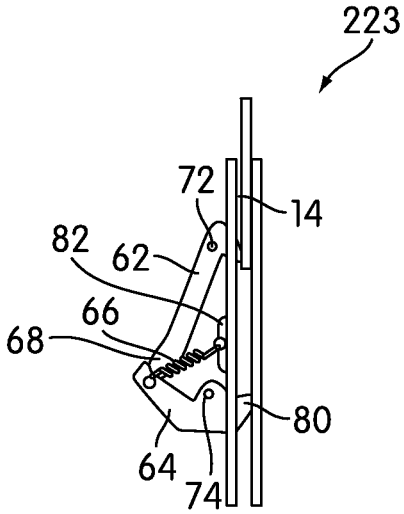

FIGS. 12*a*-12*b* show another embodiment of the present invention. The cam mechanism 223 shown in FIGS. 12*a*-12*b* includes a cam arm 62 and a blocking arm 64 disposed near a first side 38 of the throat 14. As noted previously, the first side 38 of the throat 14 and the second side 40 of the throat are spaced apart to define the thickness of the throat 14. The cam mechanism 223 is movable between an open position wherein the articles are permitted to be further inserted into the throat 14 and a closed position wherein the articles are prevented from being further inserted into the throat 14. In the embodiment shown in FIG. 12*a*, the cam arm 62 is operatively connected to a portion of the shredder 10 at a pivot point 72 and the blocking arm 64 is operatively connected to a portion of the shredder 10 at a second pivot point 74. It is contemplated that the attachment mechanisms may be pins, fasteners, and/or other attachment mechanisms known in the art. A spring 66 may be operatively connected to the blocking arm 64 and to the shredder 10 at an attachment portion 82 provided near the first side 38 of the throat 14. In one embodiment, the cam arm 62 includes a contact portion 76 that extends into the throat 14. In one embodiment, the contact portion 76 and the second side 40 of the throat 14 are spaced apart to define the gap 42 through which the articles must pass to be further inserted into the throat 14, wherein the gap 42 is smaller than the thickness of the throat 14. The cam arm 62 may include a camming portion 68 that is constructed and arranged to contact a camming surface 70 of the blocking arm 64. The blocking arm 64 may include a blocking portion 80 that extends into the throat 14 and is configured to block the throat 14 when the cam mechanism 223 is in the closed position. Furthermore, the cam mechanism 223 may be constructed and arranged to move to the closed position when the contact protrusion is pushed against with sufficient force, as will be described later.

Articles having thickness below or equal to the predetermined thickness threshold may be inserted into the throat 14 and past the gap 42 without moving the cam mechanism 223 to the closed position. However, when articles having thickness above the predetermined thickness threshold are inserted into the throat 14, the articles may push against the contact portion 76 of the cam mechanism 223 sufficiently to actuate the cam mechanism 223 to the closed position. As shown in FIG. 12*b*, when the cam mechanism 223 is in the closed position, the cam mechanism 223 blocks the throat to prevent articles from being further inserted into the throat 14.

In the embodiment shown in FIG. 12*a*, articles having thickness below or equal to the predetermined thickness threshold are able to be inserted into the throat and past the gap 42 without actuating the cam mechanism 223 to the closed position. However, as shown in FIG. 12*b*, the insertion of articles having thickness above the predetermined thickness threshold into the throat 42 may actuate the cam mechanism 223 to the closed position. When the articles having thickness above the predetermined thickness threshold are inserted into the gap 42 in the throat 14, the articles push against a contact surface 73 of the contact portion 76 of the cam arm 62. The friction between the contact surface 73 and the articles push the contact portion 76 in a downward direction and, thus pivots the cam arm 62 around the pivot point 72 in a clockwise direction. The cam arm 62 is constructed and arranged to pivot the blocking arm 64 when the cam arm 62 is pivoted. Specifically, when the cam arm 62 pivots around the pivot point 72, the camming portion 68 of the cam arm 62 may push and slide against the camming surface 70 of the blocking arm 64, thus pivoting the blocking arm 64 in a clockwise direction around the pivot point 74 of the blocking arm 64. In this embodiment, the blocking portion 80 is designed to extend into the throat 14 and block the throat 14 when the blocking arm 62 is pivoted in a clockwise direction, so that the articles may not be further inserted into the throat 14. The spring 66 maybe configured and arranged to extend when the blocking arm 64 is pivoted in the clockwise direction. In contrast, when the thick articles are removed from the gap 42 between the contact portion 76 and the second side 40 of the throat 14, the articles no longer push against the contact portion 76 and the spring 66 is able to snap back to its default relaxed position. In this embodiment, the spring 66 is configured to rotate the blocking arm 64 in a counterclockwise direction to the open position when the spring 66 snaps back to the default position, so that the blocking portion 80 is retracted from the throat 14 and is no longer blocking the throat 14. The rotation of the blocking arm 64 may cause the camming surface 70 of the blocking arm 64 to push against the cam portion 68 of the cam arm 62 and thus pivot the cam arm 62 in a counterclockwise rotation back to the open position. It is contemplated that in some embodiments, the articles may have a thickness much greater than the predetermined thickness threshold such that the contact portion 76 may engage the articles and retain the articles between the contact portion 76 and the second side 40 of the throat 14.

Figure 13A:
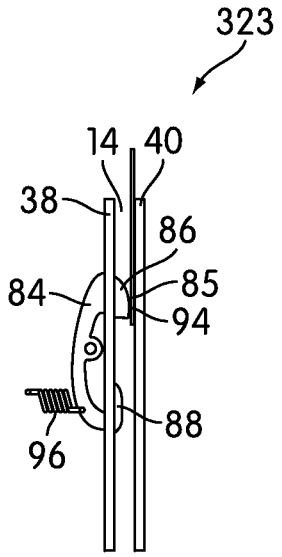
FIGS. 13*a*-13*b* are detailed views of a cam mechanism in accordance with a sixth embodiment of the present invention.
Figure 13B:
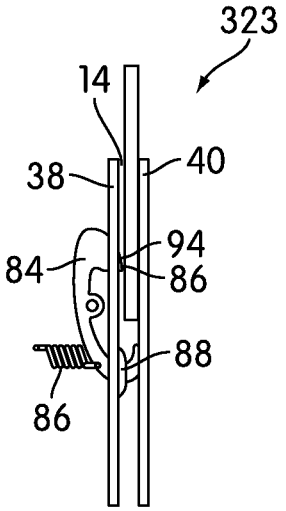

FIGS. 13*a*-13*b* show another embodiment of the present invention. In this embodiment, the cam mechanism 323 includes a cam arm 84 having a contact portion 86 and a blocking portion 88. The cam mechanism 323 may be provided near a first side 38 of the throat, and a spring 96 may be operatively connected to the cam arm 84 and to a portion of the shredder 10. In this embodiment, the cam mechanism 323 is constructed and arranged to move between the open position wherein the articles are permitted to be further inserted into the throat 14 (as shown in FIG. 13*a*) and the closed position wherein the articles are prevented from being further inserted into the throat 14 by the blocking portion 88 of the cam mechanism 323 (as shown in FIG. 13*b*). The cam mechanism 323 may be constructed and arranged to block the throat 14 when the cam mechanism 323 is actuated by the insertion into the throat 14 of articles having thickness above the predetermined thickness threshold. The spring 96 may be configured and arranged to be in a default, relaxed position when the cam mechanism is in the open position and in an extended position when the can mechanism 323 is in the closed position. In addition, the contact portion 86 and the second side 40 of the throat 14 may be spaced apart to define the gap 42 through which articles must pass to be further inserted into the throat 14.

As shown in FIG. 13*a*, articles having a thickness below or equal to the predetermined thickness threshold do not exert enough force on the contact portion 86 of the cam mechanism 323 to move the cam mechanism 323 to the closed position. The articles may pass through the space 94 without actuating the cam mechanism 323 to block the throat 14. However, as shown in FIG. 13*b*, articles having thickness above the predetermined thickness threshold may actuate the cam mechanism 323 to block the throat 14.

As shown in FIG. 13*b*, when articles having thickness above the predetermined thickness threshold are inserted into the gap 42, the articles push against a contact surface 85 of the contact portion 86 of the cam arm 84. The articles are of sufficient thickness that they may push the contact portion 86 away from the throat 14 and thus pivot the cam arm 84 in a counterclockwise direction. The pivoting of the cam arm 84 in the counterclockwise direction causes the blocking portion of the cam arm 84 to extend into the throat and block the throat 14 so that the articles may not be further inserted into the throat 14. The spring 96 may be configured and arranged to extend when the cam arm 84 is pivoted. When the user is not able to further insert the articles into the throat, this indicates to the user that the number of articles must be reduced. The user may then pull the articles out of the throat 14. In one embodiment, when the thick articles are removed from the gap 42 between the contact portion 86 and the second side 40 of the throat 14, the articles no longer push against the contact portion 86 and the spring 96 is able to snap back to its default relaxed position. As such, the spring 96 may rotate the cam arm 84 in a counterclockwise direction back to the open position. Accordingly, the blocking portion 88 of the cam mechanism 323 is retracted from the throat 14 and is no longer blocking the throat 14.

It is contemplated that in some embodiments, the shredder 10 may also include an indicator 98 (see FIG. 14) configured to indicate the insertion into the throat 14 of articles above the predetermined maximum thickness threshold. The indicator 98 may be an LED, an audible alarm, or other feedback mechanisms known in the art. The indicator 98 may be activated by the movement of the cam mechanism 23 and/or by the position of the cam mechanism 23. For example, the indicator 98 may be activated when the cam mechanism 23 is in the engaged or closed position. The indicator 98 may provide a warning signal, or emit light, when the indicator 98 is activated for a predetermined amount of time. In one embodiment, the indicator 98 does not provide a warning signal when a wrinkle in the article passes through the cam mechanism 23 such that the cam mechanism 23 is in the engaged or closed position only briefly (less than the predetermined amount of time).

Figure 14:
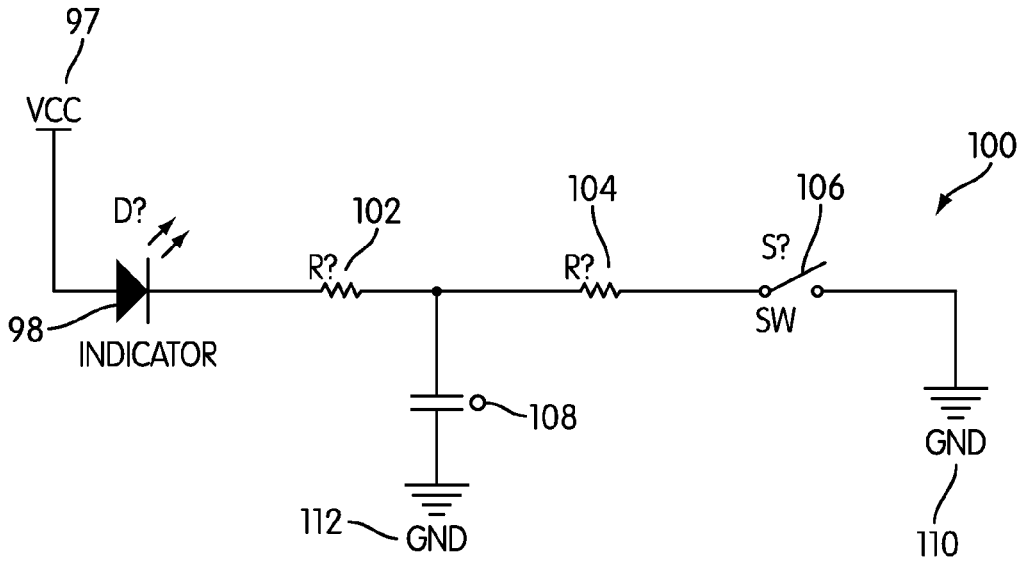
FIG. 14 illustrates a circuit diagram showing steps for emitting light using an LED as the indicator in accordance with an embodiment of the present invention.

FIG. 14 illustrates a circuit diagram 100 showing steps for emitting light using an LED as the indicator 98 in accordance with an embodiment of the present invention. The circuit 100 may be connected to the controller which may enable delivery of power to the indicator 98. The circuit 100 may include a voltage supply Vcc 97, indicator 98, resistors 102, 104, a switch 106, a capacitor 108, and circuit grounds 110, 112. Although a single LED is shown, it is contemplated that one or more LEDs, such as an array or series of LEDs may be provided. In this embodiment, when the switch 106 is an open position wherein current is prevented from flowing through the circuit 100, the indicator 98 does not emit light. When the switch 106 is in the closed position such that the current may flow through the circuit 100, the capacitor 108 will charge based on the time constant of a resistor capacitor network (defined by resistor 102 and capacitor 108). Once the capacitor 108 has been charged to a predetermined level, the indicator 98 may emit light. When the switch 106 is in the open position again, the capacitor may discharge and there may be a delay before the indicator 98 will no longer emit light. The capacitor 108 may charge and discharge according to the following equation:

$$Q(t)=Q_0e^{-t/RC}$$

where $Q_0$ is the initial charge, $\tau$ is the time constant (or elapsed time), R is the resistance value, and C is the capacitance value. The time constant $\tau$ represents the time for the system to make significant change in charge, voltage, or current whenever a capacitor 108 is charging or discharging. In this embodiment, the indicator 98 will illuminate based on the time constant $\tau$. In one embodiment, the predetermined amount of time may be determined by the time constant of the resistor-capacitor network.

In the embodiment shown in FIG. 14, the circuit 100 includes a low-pass filter (LPF) defined by the resistor 102 and the capacitor 108. The LPF is configured to eliminate or reduce the possibility of the indicator 98 flickering during the shredding process. Flickering may be caused by the forceful movement of the cutter elements 21 as the cutter elements 21 are shredding the articles, which may trigger the switch 106 momentarily. The switch 106 may also be triggered momentarily by the wrinkles that accumulate on the articles as the articles are being shredded. The variables in the above mentioned equation may be varied to obtain the optimal indicator drive and filter timing. For example, the value of the resistor 102 or the value of the capacitor 108 may be increased to increase the predetermined amount of time for the switch 106 to be depressed before the indicator 98 will illuminate. The resistor 102 and capacitor 108 values may also be changed to increase or decrease the amount of filtering required. For example, the more aggressive the cutter elements 21, the more filtering is required to prevent the indicator 98 from flickering. The embodiment shown in FIG. 14 is an example and is not intended to be limiting. It is contemplated that the filter may be omitted entirely in some embodiments. In other embodiments, filtering may be accomplished by using logic and/or software. It is also contemplated that in some embodiments, the configuration and arrangement of the circuits may vary. In some embodiments, the indicator 98 may be powered from an AC line.

It is also contemplated that audible signals may be generated in response to the insertion of articles above the predetermined thickness threshold. In one embodiment, the indicator 98 is an audible alarm. Examples of audible signals include, but are not limited to beeping, buzzing, and/or any other type of signal that will alert the user that the stack of documents or other article that is about to be shredded is above a predetermined maximum thickness and may cause the shredder mechanism 20 to jam. Reference may be made to U.S. Patent Application Publication No. 2006-0219827 A1, which is hereby incorporated by reference, for details of warning signals that may be given.

The foregoing illustrated embodiments have been provided to illustrate the structural and functional principles of the present invention and, are not intended to be limiting. To the contrary, the present invention is intended to encompass all modifications, alterations and substitutions within the spirit and scope of the appended claims.

What is claimed is:

1. A shredder comprising:

a housing having a throat for receiving at least one article to be shredded;

a shredder mechanism received in the housing and including an electrically powered motor and cutter elements, the shredder mechanism enabling the at least one article to be shredded to be fed into the cutter elements and the motor being operable to drive the cutter elements so that the cutter elements shred the at least one article fed therein;

a cam mechanism provided in the throat;

the cam mechanism being biased to a disengaged position and movable to an engaged position responsive to insertion into the throat of the at least one article above a predetermined maximum thickness threshold;

wherein the cam mechanism is configured such that in the engaged position the cam mechanism engages the at least one article to prevent further insertion thereof into the throat and blocks the throat to prevent further insertion of the at least one article therein, and in the disengaged position the cam mechanism is disengaged from the at least one article to permit further insertion thereof into the throat.

2. The shredder of claim 1, wherein the cam mechanism pivots around a pivot point to engage the at least one article.

3. The shredder of claim 2, wherein the at least one article being above the predetermined maximum thickness threshold pivots the cam mechanism to engage the at least one article.

4. The shredder of claim 2, wherein friction between the at least one article and the cam mechanism pivots the cam mechanism to engage the at least one article.

5. The shredder of claim 1, wherein the cam mechanism comprises a wheel.

6. The shredder of claim 1, wherein the cam mechanism comprises a rotatable cam member.

7. The shredder of claim 6, wherein the cam mechanism comprises an outer ring encircling the cam member.

8. The shredder of claim 7, wherein the outer ring comprises rubber material.

9. The shredder of claim 1, wherein the cam mechanism comprises a slip disk.

10. The shredder of claim 1, further comprising a sensor associated with the throat being operable to detect receipt of the at least one article into the throat.

11. The shredder of claim 1, wherein the cam mechanism comprises a spring.

12. The shredder of claim 11, wherein the spring biases the cam mechanism to the disengaged position.

13. The shredder of claim 1, wherein the cam mechanism comprises a torsion spring.

14. The shredder of claim 13, wherein the torsion spring biases the cam mechanism to the disengaged position.

15. The shredder of claim 1, further comprising a controller configured to operate the motor.

16. The shredder of claim 1, further comprising a container for receiving the at least one shredded articles or shredded particles.

17. The shredder of 1, wherein the cam mechanism comprises a cam member configured to be pivotable around a pivot point.

18. The shredder of claim 1, further comprising an indicator configured to indicate the insertion into the throat of articles above a predetermined maximum thickness threshold.

19. The shredder of claim 18, wherein the indicator is configured to emit light.

20. The shredder of claim 18, wherein the indicator is an LED.

21. The shredder of claim 18, wherein the indicator is an audible alarm.

22. A shredder comprising:

a housing having a throat for receiving at least one article to be shredded;

a shredder mechanism received in the housing and including an electrically powered motor and cutter elements, the shredder mechanism enabling the at least one article to be shredded to be fed into the cutter elements and the motor being operable to drive the cutter elements so that the cutter elements shred the articles fed therein;

a cam mechanism provided in the throat;

the cam mechanism being biased to an open position and movable to a closed position responsive to insertion into the throat of the at least one article above a predetermined maximum thickness threshold;

wherein the cam mechanism is configured such that in the open position the cam mechanism permits further insertion of the at least one article into the throat and in the closed position the cam mechanism engages the at least one article and blocks the throat to prevent further insertion of the at least one article into the throat.

23. The shredder of claim 22, wherein the cam mechanism comprises a spring configured to bias the cam mechanism in the open position.

24. The shredder of claim 22, wherein the cam mechanism is configured to pivot between the open position and the closed position around a pivot point.

25. The shredder of claim 22, further comprising a container for receiving the at least one shredded articles or shredded particles.

26. The shredder of claim 22, further comprising an indicator configured to indicate the insertion into the throat of articles above a predetermined maximum thickness threshold.

27. The shredder of claim 26, wherein the indicator is configured to emit light.

28. The shredder of claim 26, wherein the indicator is an LED.

29. The shredder of claim 26, wherein the indicator is an audible alarm.

* * * * *